US007156040B2

(12) United States Patent
Merchant et al.

(10) Patent No.: US 7,156,040 B2
(45) Date of Patent: Jan. 2, 2007

(54) EXTENDED SEMI-SUBMERSIBLE VESSEL (ESEMI)

(75) Inventors: Aziz Merchant, Signapore (SG); Anis Hussain, Singapore (SG)

(73) Assignee: Deepwater Technology Group Pte. Ltd, Singapore (SG)

( * ) Notice: Subject to any disclaimer, the term of this patent is extended or adjusted under 35 U.S.C. 154(b) by 0 days.

(21) Appl. No.: 10/960,149

(22) Filed: Oct. 7, 2004

(65) Prior Publication Data

US 2005/0169714 A1 Aug. 4, 2005

(30) Foreign Application Priority Data

Oct. 8, 2003 (SG) ..... 200306008

(51) Int. Cl.
*B63B 35/44* (2006.01)
*B63B 21/50* (2006.01)

(52) U.S. Cl. ..... 114/293; 114/293

(58) Field of Classification Search ..... 114/264–266, 114/293

See application file for complete search history.

(56) References Cited

U.S. PATENT DOCUMENTS

| | | | | |
|---|---|---|---|---|
| 4,040,215 | A | 8/1977 | Totsuka | |
| 4,829,928 | A * | 5/1989 | Bergman | 114/125 |
| 4,907,912 | A | 3/1990 | Smith | |
| 6,374,764 | B1 | 4/2002 | Davenport, III et al. | |
| 6,652,192 | B1 * | 11/2003 | Xu et al. | 405/195.1 |

* cited by examiner

*Primary Examiner*—Jesus D. Sotelo

(74) *Attorney, Agent, or Firm*—Squire, Sanders & Dempsey

(57) ABSTRACT

A semi-submersible vessel has a pair of vertically spaced pontoons with varied buoyancy. The lower pontoon is retained in a close vertical proximity to the upper pontoon when the vessel is in transit. The lower pontoon is ballasted at the deployment site, dropping the pontoon to a depth of about 32 meters below the first pontoon baseline. As a result, stability and motion characteristics of the vessel are significantly improved.

16 Claims, 3 Drawing Sheets

EXTENDED SEMI-SUBMERSIBLE VESSEL (ESEMI)

BACKGROUND OF THE INVENTION

This invention relates to offshore structures, and more particularly to offshore structures adapted for supporting oil and gas exploration/production operations at sea.

Semi-submersible vessels represent one type of an offshore structure that is used for conducting operations at sea. Semi-submersible units are often used in deep waters, where conventional bottom-supported structures are difficult to install. A typical semi-submersible unit has a superstructure deck or decks supported by columns. The columns are supported by buoyant pontoons with ballast chambers that allow the vessel to be transported to a deployment site and be flooded with water to submerge the pontoons below the water surface. Once the pontoons are lowered to the desired depth, they provide stability and reduce vessel motion response to wind and water waves.

Some semi-submersible vessels are designed with a pair of parallel horizontal pontoons, which support vertically extending columns. Other designs provide for the use of the so-called "ring pontoon," which is not necessarily circular. In most cases, the term "ring pontoon" is applied to square or rectangular pontoons that are defined by four interconnected pontoon portions. The object of the pontoons is to facilitate stability of a vessel in deep waters.

Various solutions have been offered to solve this problem. For instance U.S. Pat. No. 4,040,265 discloses a jack-up platform supported by legs that extend down and engage a mat structure resting on an ocean floor. The mat is a rectangularity-shaped structure having a plurality of chambers, where hydrocarbons may be stored. The end portions of the mat extend beyond the position of the support legs.

U.S. Pat. No. 4,907,912 illustrates another example of a jack-up rig using a submersible storage barge. During transit, the submersible storage barge-provides the flotation means for the rig hull. Once the unit reaches the drill site, the submersible barge is lowered together with the support legs until they rest upon a sea bottom. The submersible barge is at least flooded to stabilize its position on the sea bottom.

U.S. Pat. No. 6,374,764 discloses a self-floating offshore structure with one or more pontoons that are provided with lifting supports. The lifting supports, which may be rack-and-pinion gear driven jacks, telescoping hydraulic rams, system of cables and pulleys, are attached to a deck and move the deck relative to the pontoons. The pontoons may be lifted out of the water to provide an additional deck area.

While these designs work satisfactory under certain conditions, there exists a need for an offshore structure that is particularly adapted for development of small marginal fields that are located in deep waters and harsh environment.

SUMMARY OF THE INVENTION

It is an object of the present invention to provide a semi-submersible unit that has enhanced resistance to wave actions.

It is another object of the invention to increase the added mass of the unit in a simple and cost effective way by using the second tier pontoon (STP) in the ESEMI. ESEMI allows the added mass of the vessel to be increased without any increase of displacement, as would be the case with conventional semi-submersibles designs. Instead of increasing the displacement to achieve higher added mass, this invention seeks to separate the total displacement into two different locations in the operation mode. One part of this displacement is located in the conventional semisubmersible hull and the other part, called STP, is situated at a certain distance below the hull. This separation of the total displacement results in higher overall added mass for the ESEMI compared to the conventional semi-submersible of similar displacement.

It is another object of the present invention to provide an offshore structure that has significantly reduced motion responses to wave actions.

Solution to the above-mentioned problems is given according to one embodiment of the invention as defined in the patent claims below.

The major wave- and current-influenced forces act on the columns and the pontoons at the upper levels below the sea surface. These forces normally decrease with increasing depth below the surface. The vessel of the present invention provides for the use of a two-tier pontoon system. An upper ring pontoon supports stabilizing columns, which in turn support the upper hull and the deck structures. The lower pontoon moves vertically in relation to the upper pontoon through the use of an independent ballasting system housed in the lower, or second tier pontoon. By dropping the second tier pontoon (STP) to a depth well below the sea surface, preferably below the most strongly wave-influenced zone, the semi-submersible unit of the present invention achieves motion response characteristics normally only achieved by large purpose built fixed units.

According to a preferred embodiment of the invention, the second tier pontoon supports a plurality of vertically movable retractable legs. The legs move through leg guides carried by exterior of the stabilizing columns and the upper pontoon. The legs ensure that the second tier pontoon is retained in a parallel relationship to the upper pontoon.

When in transit, the lower buoyant pontoon is secured in close proximity to the upper pontoon, and the legs are fully retracted. Once the vessel reaches the operational site, the second pontoon is ballasted and lowered such that the upper pontoon baseline is about 32 meters above the second tier pontoon baseline. The second tier pontoon remains locked in relation to the upper pontoon and the upper hull through a series of winches tensioning handling lines, which connect the second tier pontoon to the main deck.

BRIEF DESCRIPTION OF THE DRAWINGS

The invention is illustrated in the following drawing figures stating non-limiting examples of an embodiment of the invention.

DETAILED DESCRIPTION OF THE PREFERRED EMBODIMENT

Figure 1:
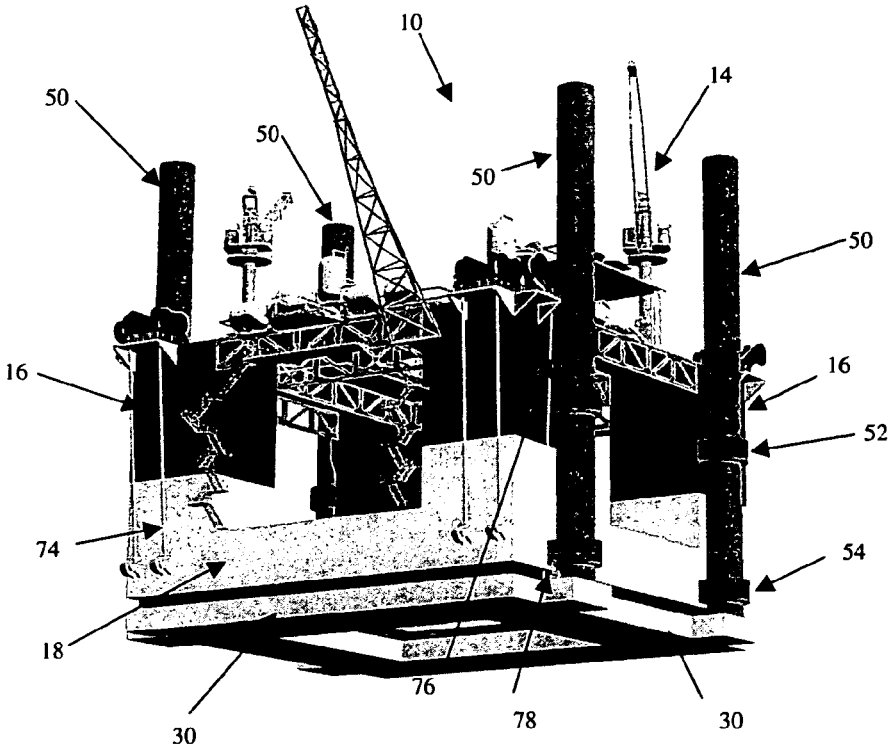
FIG. 1 is a perspective view of the semi-submersible vesel in accordance with the present invention in transit confition.
Figure 2:
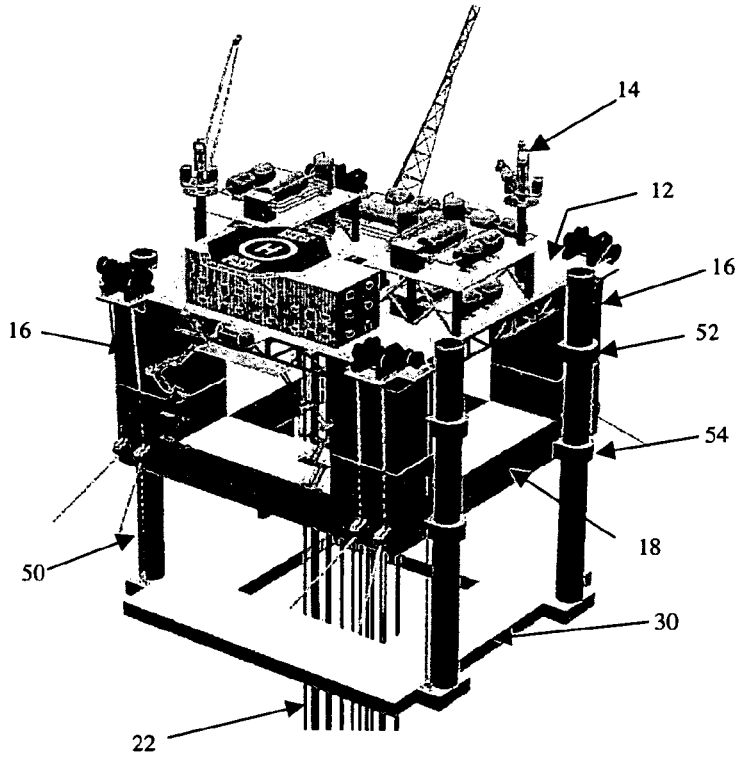
FIG. 2 is a perspective view of the semi-submersible vesel in accordance with the present invention in operating condition.

With reference to the drawings in more detail, the semi-submersible vessel of the present invention is designated by numeral 10. The vessel or unit 10 comprises an upper hull 11 having an operating deck 12. The upper hull 11 is designed as a big box or grillage structure. The hull 11 and the deck 12 support various machinery and equipment, as well as crew housing. For handling goods delivered by supply ships there are cranes 14.

The upper hull 11 and the operating deck structure 12 are carried by four vertical columns 16, which in turn are supported by a main pontoon structure 18 formed as a square ring Each column 16 has a rectangular cross-section and extends from a corner of the square ring pontoon 18. The main pontoon 18 is comprised of four box-like structures, each having a four-sided cross-section. One of the main advantages of the ring pontoon is a significant torsional strength in the vessel structure, which is particularly important in harsh environments. The main pontoon 18 has a quadrate opening 20 allowing production risers 22 to extend therethrough.

The main pontoon 18 houses a plurality of ballast tanks 24, storage tanks 26, pump rooms 28 located in each corner of the pontoon 18 and associated machinery for delivering, storing and exporting water and hydrocarbons necessary in the operation of the production vessel 10. The main pontoon 18 is rigidly secured to the columns 16.

A second tier pontoon (STP) 30 is secured in parallel vertically spaced relationship to the main pontoon 18. The STP 30, similarly to the main pontoon 18 is made of four box-like structures 32, 34, 36, and 38, each having a four-sided cross-section. The pontoon 30 has a quadrate opening 40 vertically aligned with the quadrate opening 20 of the main pontoon 18 to allow production risers 22 to extend therethrough. The second tier pontoon 30 has a shallower depth than the main pontoon 18.

The portion 32 of the pontoon 30 has a pair of horizontal extensions 42, 44. The portion 36 of the pontoon 30 has a pair of horizontal extensions 46, 48. The extensions 42, 44, 46 and 48 each support a vertically extending retractable extension leg 50, such the bottom of each retractable leg 50 rests on a respective extension 42, 44, 46, or 48.

The legs 50 connect the upper hull 11 and the main pontoon 18 with the second tier pontoon 30. A guide member 52 is attached to each of the columns 16; a guide member 54 is attached to the main pontoon 18 in vertical alignment with the guide member 52. Each leg 50 is received through an opening formed by the guide member 52 and the guide member 54, The legs 50 move in relation to the hull 11 and the main pontoon 18, thereby moving the second tier pontoon 30 to the operational draft.

Figure 3:
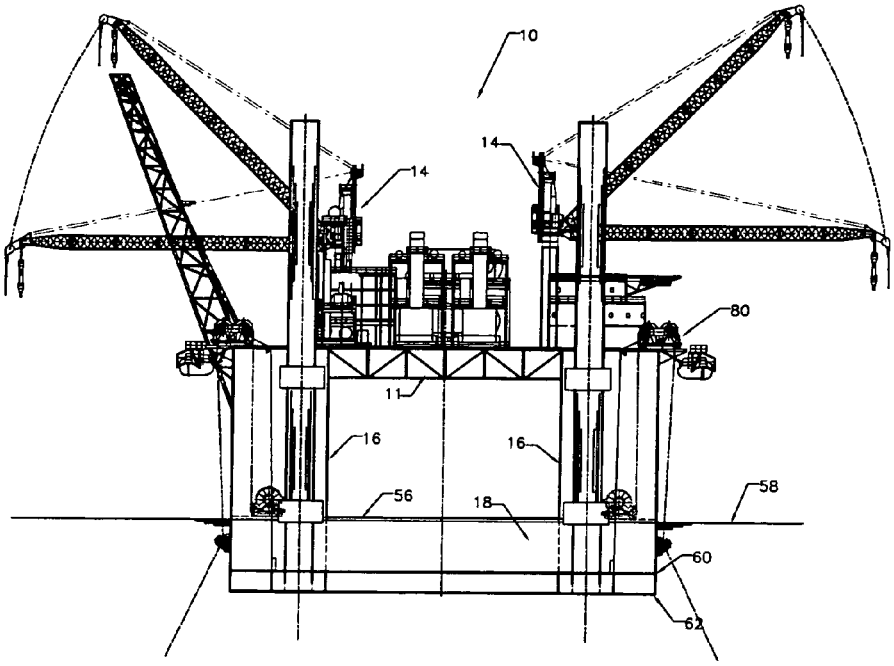
FIG. 3 is profile of the semi-submersible vessel of the present invention in transit condition.
Figure 4:
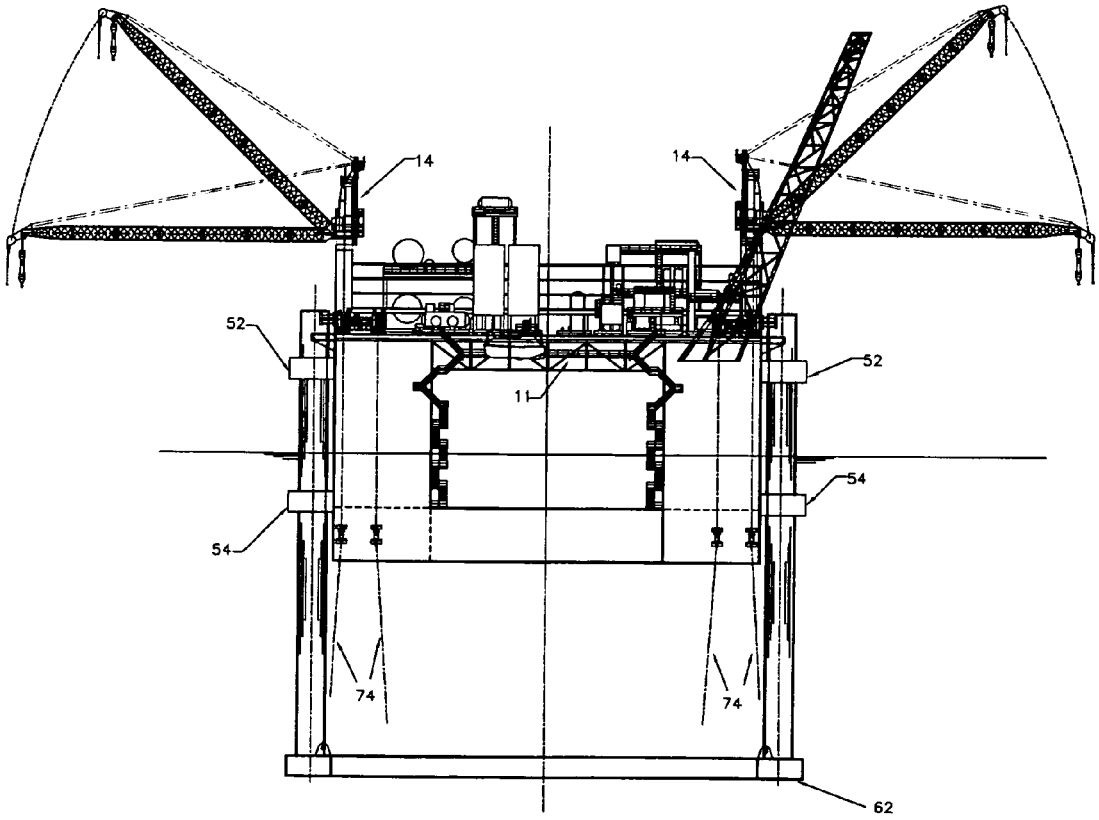
FIG. 4 is a bow view of the vessel of the present invention in operating condition.
Figure 5:
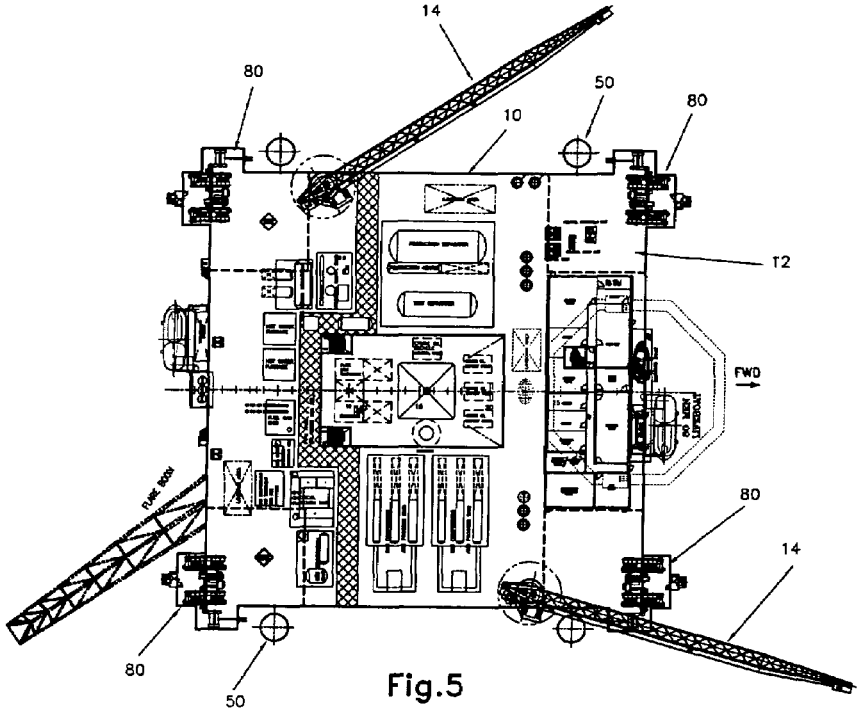
FIG. 5 is a plan view fo the main deck of the vessel of the present invention.
Figure 6:
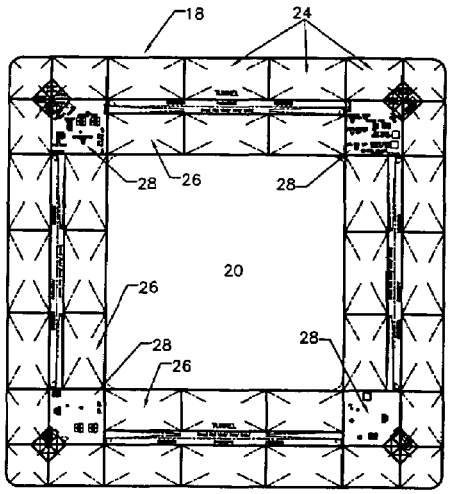
FIG. 6 is a schematic view of the main pontoon bottom.
Figure 7:
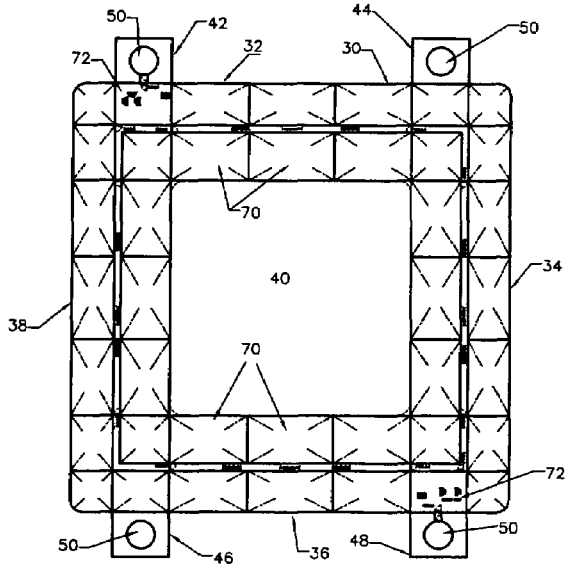
FIG. 7 is a schematic view of the second tier pontoon bottom.

When in transit (FIGS. 1 and 3), the STP 30 is located a short distance below the main pontoon 18. In transit draft, the deck 56 of the main pontoon 18 is lightly above the water line 58. The main pontoon baseline 60 is submerged below the water surface, while the baseline 62 of the second tier pontoon is located about 3 m below the main pontoon baseline 60.

The second tier pontoon 30, similarly to the main pontoon 18, is divided by vertical and transverse bulkheads into a plurality of compartments that house ballast tanks 70. Suitable pumps in pump rooms 72 are provided facilitate variable ballasting of the tanks 70.

When the vessel 10 is deployed at the operating site, the second tier pontoon 30 is lowered well below the water line 58, such that the baseline 62 of the second tier pontoon 30 is about 32 m below the baseline 60 of the main pontoon 18. To facilitate mooring and handling of the second tier pontoon 30, the vessel 10 is equipped with eight mooring lines 74, two at each corner of the vessel 10. A handling line 76 is provided for each extension 42, 44, 46, and 48. One end of the STP handling line is secured in an attachment member 78 mounted on the top surface of each extension member 42, 44, 46, and 48.

The vessel 10 is designed to operate in water depths up to 2500 m using a pre-laid mooring system. To facilitate station keeping of the vessel 10, there are provided four double drum traction winch assemblies 80. Wire storage reels are located inside the columns 16. The winch assemblies 80 serve dual purpose: they carry mooring lines 74 and the pontoon handling lines 76. Each winch assembly 80 uses the double traction winch for mooring and a single traction winch for handling of the second tier pontoon 30. Preferably, there is one common shaft for driving the traction winches of the STP handling winches connected individually and in turn through external clutches.

The winch assemblies 80 are driven by variable speed motors of conventional design. Control panels for each winch assembly 80 are operationally connected to a centralized control panel to synchronize tension in the mooring lines 74 and pay out of the STP handling lines 76.

The process of lowering the second tier pontoon provides for the use of a static holding brake (not shown), which is part of each winch assembly 80. The second tier pontoon is free-flooded from se chests provided in the second tier pontoon.

Once the operator ensures that the ballast water amount does not exceed a pre-determined amount, the locking pins of the winch assemblies are released. With the help of a dynamic brake, the handling lines 76 are unwound from the winches 80 and the second tier pontoon is allowed to submerge to the desired depth under water. Once the pre-determined depth has been achieved, the operator applies a static holding brake and engages a locking mechanism (not shown) associated with each handling line 76.

While the pontoon 30 is being lowered, the legs 50 slidably move within the guide members 52, 54, retaining parallel position of the second tier pontoon 30 in relation to the hull 11 and the main pontoon 18.

To raise the second tier pontoon 30, the operator applies a static holding brake and unlocks the pins of the retractable legs 50. The second tier pontoon is de-ballasted, while the winch assemblies 80 maintain tension of wires 76, raising the second tier pontoon to a draft of about 26 meters. The static holding brake is then applied, and the second tier pontoon is again de-ballasted. With the winch assemblies 80 pulling on the handling lines 76, the second tier pontoon is raised again to a draft of about 10.5 meters.

This process continues until the second tier pontoon 30 reaches the desired elevation. Then, the static holding brakes are applied and the second tier pontoon 30 is locked to the columns with the help of special pins, which are capable of taking the STP static weight and the dynamic forces. It is envisioned that the pumps of the second tier pontoon 30 will be capable of complete de-ballasting of the second tier pontoon to facilitate retraction of the pontoon 30 in eight hours.

The ballast system of the main pontoon and the second tier pontoon is capable of restoring the vessel 10 to a normal operating condition or transit draft and a level trim condition, when subject to damage and flooding conditions. In case of emergency, de-ballasting and retraction of the second tier pontoon may be accomplished in about 4 hours.

The vessel 10 provides for two functionally different ballast systems: first is located in the second tier pontoon and its purpose is to facilitate deployment and retraction of the second tier pontoon. The second ballast system is provided in the main pontoon; its purpose is trim adjustments, ballast and de-ballast between transit, operational and survival drafts and to enable restoration of the unit from damaged conditions.

Once the second tier pontoon is extended to the desired water depth and locked to the main pontoon 18 and the hull 11, the dual-purpose winch assemblies 80 are changed over to use in mooring the vessel 10 at the deployment site.

The vessel 10 of the present invention allows for the topside, the main pontoon and the second tier pontoon to be manufactured at a shipyard as an integrated unit, which eliminates the need for integration on location. As a result, significant time period can be saved for a vessel owner. The second tier pontoon not only provides a larger added mass but also significantly reduces the vessel's motions. The vessel motion response is substantially equal to responses that may be achieved by large purpose built fixed bottom units. The lower motion characteristics translate into less "down time" and riser fatigue.

The components forming part of the vessel in accordance with the present invention may be varied within the scope of the appended claims.

We claim:

1. A semi-submersible vessel, comprising:

a first ring pontoon supporting an upper hull;

a second ring pontoon disposed parallel to and vertically spaced from the first pontoon; and a means for vertically moving the second pontoon in relation to the first pontoon;

wherein said second pontoon has a box-like structure and wherein a plurality of horizontal extensions extends from said box-like structure.

2. The vessel of claim 1, wherein said means for moving the second pontoon comprises winch assemblies mounted on a deck of the upper hull and handling lines secured to the second pontoon and tensioned by said winch assemblies.

3. The vessel of claim 2, wherein said means for moving the second pontoon further comprise a ballasting means housed in the second pontoon.

4. The vessel of claim 1, further comprising a means for retaining the second pontoon in a parallel relationship to said first pontoon.

5. The vessel of claim 4, wherein said means for retaining the second pontoon in a parallel relationship to said first pontoon comprises leg guides secured to the first pontoon and the upper hull and a plurality of retractable legs fixedly attached to said second pontoon and slidably movable within said leg guides.

6. The vessel of claim 5, wherein each of said retractable legs is secured to and extends upwardly from a corresponding extension.

7. The vessel of claim 1, further comprising a plurality of stabilizing columns extending from said first pontoon and supporting the upper hull by top portions thereof.

8. A semi-submersible vessel, comprising:

a first buoyant ring pontoon;

an upper hull supported on stabilizing columns extending upwardly from the first pontoon;

a second ring pontoon disposed below the first pontoon in a parallel relationship to and vertically spaced from, the first pontoon;

a plurality of retractable legs secured to the second pontoon and vertically movable in relation to the first pontoon and the upper hull; and a means for vertically moving the second pontoon in relation to the first pontoon;

wherein said first pontoon and said second pontoon are each rectangular ring pontoons having box-like structures and four-sided cross-section.

9. The vessel of claim 8, wherein said means for moving the second pontoon comprises winch assemblies mounted on a deck of the upper hull and handling lines secured to the second pontoon and tensioned by said winch assemblies.

10. The vessel of claim 8, wherein said second pontoon has a plurality of horizontal extensions, and wherein each retractable leg is secured to and extends upwardly from a corresponding extension.

11. The vessel of claim 8, further comprising a means for retaining the second pontoon in a parallel relationship to said first pontoon.

12. The vessel of claim 11, wherein said means for retaining the second pontoon in a parallel relationship to said first pontoon comprises leg guides secured to the first pontoon and to the upper hull, and wherein said retractable legs slidably move through said leg guides.

13. A semi-submersible vessel, comprising:

a first buoyant ring pontoon, a plurality of stabilizing columns extending upwardly from said first pontoon;

an upper hull supported on the stabilizing columns;

a second buoyant ring pontoon disposed below the first pontoon in a parallel relationship to and vertically spaced from, the first pontoon;

a plurality of retractable legs secured to the second pontoon and vertically movable in relation to the first pontoon and the upper hull;

a means for retaining the retractable legs in a secure relationship to the first pontoon and the upper hull, said means comprising a plurality of guides secured to the upper hull and the first pontoon for receiving the legs in a slidable engagement therein; and a means for vertically moving the second pontoon in relation to the first pontoon, said means comprising winch assemblies mounted on a deck of the upper hull and handling lines secured to the second pontoon and tensioned by said winch assemblies;

wherein said first pontoon and said second pontoon each have independent ballasting systems housed within a corresponding pontoon.

14. The vessel of claim 13, wherein the ballasting system of the second pontoon facilitates lowering and retracting of the second pontoon between an operational draft and a transit draft.

15. A semi-submersible vessel, comprising:

a first buoyant ring pontoon;

an upper hull supported on stabilizing columns extending upwardly from the first pontoon;

a second ring pontoon disposed below the first pontoon in a parallel relationship to and vertically spaced from, the first pontoon;

a plurality of retractable legs secured to the second pontoon and vertically movable in relation to the first pontoon and the upper hull; and a means for vertically moving the second pontoon in relation to the first pontoon;

wherein said first pontoon and said second pontoon each comprise independent means for ballasting the first pontoon and the second pontoon, and wherein the ballasting means of the second pontoon facilitates movement of the second pontoon in relation to the first pontoon.

16. A semi-submersible vessel, comprising:

a first buoyant ring pontoon, a plurality of stabilizing columns extending upwardly from said first pontoon;

an upper hull supported on the stabilizing columns;

a second buoyant ring pontoon disposed below the first pontoon in a parallel relationship to and vertically spaced from, the first pontoon;

a plurality of retractable legs secured to the second pontoon and vertically movable in relation to the first pontoon and the upper hull;

a means for retaining the retractable legs in a secure relationship to the first pontoon and the upper hull, said means comprising a plurality of guides secured to the upper hull and the first pontoon for receiving the legs in a slidable engagement therein; and a means for vertically moving the second pontoon in relation to the first pontoon, said means comprising winch assemblies mounted on a deck of the upper hull and handling lines secured to the second pontoon and tensioned by said winch assemblies;

wherein said first pontoon and said second pontoon have peripheral surfaces, and wherein said retractable legs extend outside of said peripheral surfaces.

* * * * *